US011274475B2

(12) United States Patent
Beck et al.

(10) Patent No.: US 11,274,475 B2
(45) Date of Patent: Mar. 15, 2022

(54) DOOR-HANDLE SYSTEM FOR VEHICLES

(71) Applicant: Huf Hülsbeck & Fürst GmbH & Co. KG, Velbert (DE)

(72) Inventors: Andreas Beck, Bochum (DE); Ulrike Fichert, Wuppertal (DE)

(73) Assignee: Huf Hülsheck & Fürst GmbH & Co. KG, Velbert (DE)

( * ) Notice: Subject to any disclaimer, the term of this patent is extended or adjusted under 35 U.S.C. 154(b) by 924 days.

(21) Appl. No.: 15/740,357

(22) PCT Filed: May 31, 2016

(86) PCT No.: PCT/EP2016/062218
§ 371 (c)(1),
(2) Date: Dec. 28, 2017

(87) PCT Pub. No.: WO2017/001130
PCT Pub. Date: Jan. 5, 2017

(65) Prior Publication Data

US 2018/0187458 A1 Jul. 5, 2018

(30) Foreign Application Priority Data

Jun. 30, 2015 (DE) ..... 10 2015 110 531.4

(51) Int. Cl.
*E05B 79/06* (2014.01)
*E05B 15/16* (2006.01)
(Continued)

(52) U.S. Cl.
CPC ..... *E05B 79/06* (2013.01); *E05B 15/1635* (2013.01); *E05B 85/06* (2013.01);
(Continued)

(58) Field of Classification Search
CPC ..... E05B 79/04; E05B 79/06; E05B 85/10; E05B 85/06; E05B 85/16; Y10S 292/64; Y10S 292/53; Y10S 292/57
See application file for complete search history.

(56) References Cited

U.S. PATENT DOCUMENTS 6,059,329 A 5/2000 Spitzley
6,234,548 B1 * 5/2001 Mittelbach ..... E05B 79/06 292/336.3
(Continued)

FOREIGN PATENT DOCUMENTS

CN 204112941 1/2015
CN 104417327 3/2015
(Continued)

OTHER PUBLICATIONS

Machine Translation of EP 1306503 A1, 2020, pp. 1-20 (Year: 2020).*
(Continued)

*Primary Examiner* — Christine M Mills
*Assistant Examiner* — Faria F Ahmad

(57) ABSTRACT

A door handle system for actuation of a moveable part of a vehicle with a carrier arrangeable at the inner side of the moveable part, a door handle arrangeable at the outer side of the moveable part by the carrier. The door handle comprises two ends over a longitudinal extension at which connecting means are provided for the arrangement at the carrier respectively, a fasteningelement which serves for the arrangement of the door handle by connecting means at the carrier. The fasteningelement comprises at least one release position and one fixing position and an adjustment element for the adjustment of the fastening element The fastening element retains the door handle at the carrier in a fixing position. The fastening element is configured from two
(Continued)

parts, wherein the two parts of the fastening element are coupled to one another.

21 Claims, 7 Drawing Sheets

(51) Int. Cl.

| | |
|---|---|
| ***E05B 85/06*** | (2014.01) |
| ***E05B 85/16*** | (2014.01) |
| ***E05B 85/10*** | (2014.01) |
| ***E05B 79/04*** | (2014.01) |
| ***E05B 77/04*** | (2014.01) |

(52) U.S. Cl.
CPC ..... *E05B 85/16* (2013.01); *E05B 77/04* (2013.01); *E05B 79/04* (2013.01); *E05B 85/10* (2013.01); *Y10S 292/53* (2013.01); *Y10S 292/64* (2013.01); *Y10T 292/57* (2015.04)

(56) References Cited

U.S. PATENT DOCUMENTS

| | | | | |
|---|---|---|---|---|
| 6,594,861 | B2 * | 7/2003 | Dimig | E05B 79/06 16/412 |
| 7,344,168 | B2 * | 3/2008 | Matsubara | E05B 79/06 292/336.3 |
| 7,971,913 | B2 * | 7/2011 | Sunahara | E05B 85/16 292/336.3 |
| 2013/0020816 | A1 * | 1/2013 | Saitou | E05B 79/06 292/336.3 |

FOREIGN PATENT DOCUMENTS

| | | | | |
|---|---|---|---|---|
| DE | 29819472 | | 2/1999 | |
| DE | 19950172 | A1 * | 4/2001 | E05B 79/06 |
| DE | 10151870 | A1 * | 5/2003 | E05B 83/36 |
| DE | 102007027845 | | 12/2008 | |
| DE | 102012104889 | | 12/2013 | |
| DE | 102013102105 | A1 * | 9/2014 | E05B 85/18 |
| DE | 102018107503 | A1 * | 10/2019 | E05B 79/06 |
| EP | 1026347 | | 8/2000 | |
| EP | 1306503 | A1 * | 5/2003 | E05B 81/76 |
| EP | 1355022 | A2 * | 10/2003 | E05B 79/06 |
| EP | 1473423 | A2 * | 11/2004 | E05B 77/04 |
| WO | WO 2015/128332 | | 9/2015 | |

OTHER PUBLICATIONS

Notification of Office Action dated Sep. 20, 2019 From the China National Intellectual Property Administration Re. Application No. 201680029848.4 and Its Translation Into English. (6 Pages).

Internationaler Recherchenbericht und Schriftlicher Bescheid [International Search Report and the Written Opinion] dated Sep. 22, 2016 From the International Searching Authority Re. Application No. PCT/EP2016/062218 and Its Translation of Search Report Into English. (14 Pages).

Mitteilung Gemäss Artikel 94(3) EPÜ [Communication Persuant to Article 94(3) EPC] dated Sep. 3, 2020 From the European Patent Office Re. Application No. 16726856.4 and Its Summary in English. (5 Pages).

Notification of Office Action and Search Report dated Mar. 5, 2019 From the China National Intellectual Property Administration Re. Application No. 201680029848.4 and Its Translation Into English. (13 Pages).

Mitteilung Gemäss Artikel 94(3) EPÜ [Communication Persuant to Article 94(3) EPC] dated Apr. 14, 2020 From the European Patent Office Re. Application No. 16726856.4 and Its Summary in English. (5 Pages).

Mitteilung Gemäss Artikel 94(3) EPÜ [Communication Pursuant to Article 94(3) EPC] dated Mar. 6, 2019 From the European Patent Office Re. Application No. 16726856.4 and Its Summary in English. (5 Pages).

* cited by examiner

DOOR-HANDLE SYSTEM FOR VEHICLES

RELATED APPLICATIONS

This application is a National Phase of PCT Patent Application No. PCT/EP2016/062218 having International filing date of May 31, 2016, which claims the benefit of priority of German Patent Application No. 10 2015 110 531.4 filed on Jun. 30, 2015. The contents of the above applications are all incorporated by reference as if fully set forth herein in their entirety.

FIELD AND BACKGROUND OF THE INVENTION

The present invention is directed a door handle system for actuating a moveable part of a vehicle, particularly a door or hatchback door or the like according to the preamble of claim 1. Thereby, a carrier is provided at the door handle system which is arrangeable at an inner side of the moveable part. Further, the door handle system comprises a door handle which is arrangeable at the outer side of the moveable part by way of the carrier, and the door handle has two ends over its longitudinal extension at which connection means are provided for fastening at the carrier respectively. Further, the door handle system comprises a connection means which serves for fastening the door handle at the carrier by at least one connection means, wherein the fastening element comprises at least one release position and a fixing position and having an adjustment element which serves for adjusting the fastening element between the release position and the fixing position. In its fixing position the fastening means retains the door handle on the carrier by way of both connection means. Further, the present invention is directed to a method for assembly of a door handle system for actuating a moveable part of a vehicle according to the preamble of claim 20.

From reference DE 10 2007 027 845 A1 for example a door handle system for acting a moveable part of a vehicle is known, particularly a door or a hatchback door by which a carrier is arranged at the inner side of the moveable part and serves for the fixation of a door handle at the outer side of the moveable part. Thereby, the door handle comprises a first handle end and a second handle end which are arranged via a complex assembly at the carrier of the door handle system. An arrangement at the door handle at the carrier is necessary by multiple complex assembly steps.

Therefore, it is the object of the present invention to provide a door handle system and a method for the assembly of a door handle system which at least partially overcomes the disadvantages from the state of the art. Particularly, it is an object of the present invention to facilitate the mechanical construction of the door handle system for arrangement of the door handle at the carrier and the assembly at the moveable part.

The present invention is solved by a door handle system with the features of claim 1, particularly from the characterizing clause. Likewise, an assembly method for the assembly of the door handle system with the features of claim 20, particularly from the characterizing clause for solving the object, is suggested. In the dependent device and method claims the preferred embodiments of the invention are described. Features which are disclosed in relation to the door handle system according to the invention thereby also apply for the assembly method according to the invention and vice versa. Further, the assembly method according to the invention from claim 20 can be performed with a door handle system according to the invention.

SUMMARY OF THE INVENTION

The door handle system according to the invention for actuating a moveable part of the vehicle, particularly a door or a hatchback door or suchlike equipped with a carrier which is arrangeable at the inner side of the moveable part. Additionally, this door handle system comprises a door handle which is arrangeable at the outer side of the moveable part by carrier. The door handle comprises two ends by its longitudinal extension at which connecting means for a fixation at the carrier are intended respectively. Such a door handle is for example configured as a pulling handle. In order to realize that the connecting means can mechanically interact with the carrier for fixation corresponding openings can be provided in the moveable part through which the connecting means extend. Further, the door handle system is equipped with a fastening element which serves for the particularly formfitting arrangement of the door handle at the carrier by at least one connecting means. Hereby, the fastening element comprises at least one release position and one fixing position. In the release position the door handle is released and therewith not directly or indirectly arranged with the carrier. In the fixing position, however, the door handle is directly or indirectly arranged at the carrier by the fastening element. Further, the door handle system comprises an adjusting element which serves for adjusting the fastening element between the release position and the fixing position. Therewith, the fastening element is moved back and forth between the release position and the fixing position by the adjusting element. In its fixing position the fastening element retains the door handle at the carrier by both connecting means or the existing connecting means. Thereby, the fastening element at the same time fixes the existing connecting means of the door handle at the carrier. According to the invention it is provided that the fastening element is configured from two parts, wherein both parts of the fastening element are coupled to one another. Meaning the two parts of the fastening element are coupled to one another after its assembly at the carrier of the door handle system, particularly loss-proof. The first part is preferably configured as a clip which serves for the acceptance and arrangement of a closing cylinder while the second part is preferably configured as a locking plate. By this configuration in two parts the fastening element can be arranged at the carrier or the door handle of the door handle system, particularly easily and securely, particularly loss-proof. Therewith, the door handle is arrangeable or can be mounted at the moveable part, particularly easily and securely by the present configuration of the door handle system. With a door handle system according to the invention it is possible by a two part configuration of the fastening element to use different materials or material thicknesses for the respective parts of the fastening element. Thus, for example the first part of the fastening element can be configured from a casting part, particularly a metal casting part or a light metal casting part. The second part of the fastening element, however, can be configured from a forged part or a rolled sheet part. The coupling meaning the mechanic connection between the first and second part of the fastening element can be realized by a connecting means. Ideally, thereby the two parts of the fastening means are at least form fittingly arranged with one another by the connecting means. The arrangement of this two part fastening element is particularly simplified when both parts are only coupled with one another after the arrangement at the carrier.

It is particularly preferred with the door handle system that the door handle system is configured such that a coupling of both parts of the fastening element can only occur when at least one of the parts of the fastening elements is retained at the carrier of the door handle system, particularly loss-proof.

Within the scope of the invention it can be provided that the first part comprises at least a coupling element and the second part at least a counter coupling element, wherein the at least one coupling element is formfittingly connected at the least one counter coupling element. Preferably, the at least one coupling element and the at least one counter coupling element configure a plug system, wherein the at least one coupling element and the at least one counter coupling element are plugged in one another to establish the coupling, particularly are engaged with one another. Thus, the at least one coupling element can be configured as a plug projection and the at least one counter coupling element as a complementary plug recess. The at least one coupling element and the at least one counter coupling element are formfittingly connected with one another after the establishment of the coupling connection such that a movement of one part results in the same movement of the other part.

According to a particularly preferred embodiment of the invention it can be provided with a door handle system that the second part is configured elastically deformable at the end facing the first part. This means that the end of the second part facing the first part is configured such that this end deforms into the original condition after a load. This means that the elastic deformation occurs over time in which a corresponding load is affecting. Such a configured second part enables a particularly secure and durable coupling between the first and the second part of the fastening element. For coupling of both parts to one another the elastically deformable end of the second part can be deformed for a short period of time in order to then be received in a certain position receive a formfitting coupling with a first part. A big advantage of the elastic deformability of the edge of the second part facing the first part is that during the mounting of the second part at the carrier and a therewith connected subsequent fixation of the second part at the carrier the elastically deformable end can flexibly yield in order to accept a no longer losable plug or resting connection with this and a subsequent coupling period, particularly in a linear displacement of the second part into the direction of the first part. The door handle system, particularly the carrier and the two parts of the fastening elements are configured constructive such that after the assembly of the first part at the carrier and during the assembly of the second part at the carrier a coupling of both parts occurs, but the elastically deformable end elastically deforms during the assembly of the second part due to a striking at the first part, particularly to the coupling element of the first part. Only after a displacement process of the second part along the carrier with which the second part is only linearly displaceably retained at the carrier and a therewith connected moving towards one another of the second part and the first part, both parts are adjusted to one another such that this, particularly the coupling element and the counter coupling element accept a durable formfitting connection with one another. For example, a coupling element configured as a resting projection of the first part can engage in a counter coupling element configured as a resting acceptance. Naturally, within the scope of the invention it is considered equal when the end of the first part facing the second part is configured elastically deformable and not the end of the second part. Herefor, the selection of the materials of both parts is crucial.

Likewise, it is possible within the scope of the invention that the first part is configured ring-like. Hereby, multiple advantages result. Initially, the first part configures an acceptance for a closing cylinder. The closing cylinder can be inserted into the inner of the ring-like configured first part after the assembly and the final positioning of the first part at the carrier of the door handle system and can be fixed securely at the door handle of the door handle system after a displacement of the same. Further, such a form of the first part enables that on the face, meaning on the side of the first part facing away from the second part, an adjustment element, particularly a screw can be arranged which serves to alter the position of the first part and therewith the fastening element between the release position and the fixing position. Particularly, the ring like configured first part comprises a thread hole in the wall to the acceptance of the screw. The thread hole is pivotably mounted preferably coaxial to the displacement direction of the first part or the fastening elements at the first part. Hereby, the first part itself or after coupling with the second part can be simply linearly displaced. By the frontal arrangement of the flat hole in the first part the screw for the assembly of the fastening element, particularly for coupling of both parts of the fastening elements to one another is easily accessible for a worker.

Within the scope of the invention it can be intended that the door handle is rigidly and fixed arranged at the movable part. Thereby, the fastening element serves for the rigid arrangement of the door handle at the carrier. Therewith, the door handle itself is fixed at the carrier and therewith at the moveable part. Particularly, with a rigidly configured door handle the construction of the whole door handle system is configured particularly easy.

Likewise, it is possible within the scope of the invention that the door handle of a door handle system can be arranged moveably meaning it is turnably or pivotably or extractably. Hereby, the door handle can be arranged via a bearing block indirectly at the carrier by the fastening element. For fastening of the moveable door handle one or multiple existing connecting means of the door handle can be arranged via bearing blocks at the carrier. The composition of the door handle system with a moveable door handle is configured more complex by the additional use of at least one bearing block than with a rigidly configured door handle. Additionally, with a door handle system with a moveable door handle equalising weights and crash locks or safety catchers can be provided for increasing the safety, particularly with a crash. Further, a moveable door handle serves appropriately for mechanically actuating a lock for closing the moveable part.

Like previously described preferably a door handle system according to the invention is provided, wherein the fastening element is displaceably, particularly between the release position and the fixing position, mounted at the carrier. Therewith, only by a displacement of the fastening elements from the release position into the fixing position the door handle can be formfittingly arranged at the carrier. Hereby, the fastening element, particularly a second part of the fastening element, can be retained via guidance means at the carrier. For this purpose, the guidance means at the carrier can be configured wing-like or t-like and can formfittingly interact with corresponding counter guidance means like wing-like projections or longitudinal holes at the second part of the fastening elements in order to establish a guidance for the fastening element, at least for the second part of the fastening element. Ideally, the longitudinal holes in the fastening element are configured with an extension in order to be able to insert the fastening element via the head of the t-like guidance means. Appropriately, the distance of the extension of the longitudinal holes to the distance of the t-like guidance means at the carrier is adjusted, wherein the distance is the same respectively. After the fastening element with its extensions is guided from the longitudinal holes via the t-like head of the guidance means of the carrier the fastening means only needs to be displaced longitudinally, whereby a formfitting guidance between the fastening element and the carrier is realized. Preferably, the guidance means are configured wing-like meaning the carrier can comprise two opposing natural walls at which inner sides multiple wing-like projections are arranged spaced to one another respectively. The second part of the fastening element comprises corresponding recesses at both longitudinal sides such that the second part can be plugged to the carrier via the wing-like configured guidance means at the carrier. The wing-like configured guidance means at the carrier and the corresponding wing-like projections meaning the counter guidance means at the second part which laterally limit the recesses at the second part engage consecutively after a relative displacement of the second part to the carrier such that the second part is retained after a displacement counter its plug direction on the carrier.

It can be preferably provided with a door handle system according to the invention that the second part of the fastening element comprises longitudinal holes/recesses, wherein the longitudinal holes/recesses, the guidance means at the carrier and the at least one coupling element and the at least one counter coupling element are configured and are adjusted to one another such that the second part is pluggable to the carrier with a lining arrangement of the longitudinal holes/recesses to the guidance means of the carrier and the second part can be formfittingly coupled with the coupling element of the first part via the counter coupling element only after displacement of the second part along the guidance means at the carrier in which the second part is displaceably mounted at the carrier. By such a configuration of the door handle system a coupling of both parts of the fastening elements is possible after its arrangement at the carrier, wherein in the coupling position in which both parts have a formfitting connection with one another at least the second part is arranged counter its plug direction at the carrier. Particularly, the displaceability of the first part at the carrier is limited such that after the coupling of the second part to the first part the second part can no longer be displaced in the position in which it was plugged to the carrier meaning in which the first part was plugged to the carrier via its recesses/longitudinal holes via the guidance means. Hereby, it is ensured with the door handle system that the coupled parts of the fastening elements are retained loss-proof at the carrier.

Optional, it is possible within the scope of the invention that for arranging at least the carrier or the door handle openings are provided at the moveable part. Through these openings the connecting means of the door handle extend in order to arrange those at the carrier. The carrier itself can be arrangeable at the moveable part by at least one preferably multiple retaining means. Hereby, the support means can be configured hook-like and at least formfittingly engage with the opening edges of the openings in the moveable part. Ideally, thereby the openings of the moveable part are used which are also provided for the performance of the door handle. In order to achieve a possibly high stability of the moveable part the openings for the door handle should be configured geometrically complementary to the extending connection means of the door handle. The previously described support means of the carrier extend from the inner side of the moveable part through the openings and engage with the outer side of the opening edges.

In order to fix the carrier locally secure at the moveable part at least a fastening element can be intended which fixes the carrier at the moveable part. Hereby, it is possible that the fastening element is configured as a screw and interacts with at thread at the carrier in a mounting position at the moveable part. Thus, after the carrier is initially formfittingly arranged in the moveable part via its support means it is fixed by the fastening element in its local position at the moveable part. Hereby, it is ensured that the carrier remains in its desired position at the moveable part. Ideally, the fastening element is arranged at the door handle system such that it is externally covered from the door handle. The fastening element itself is normally inserted from the outer side through an opening in the moveable part into the carrier and therewith connected for example by said thread.

Further, it is possible according to the invention that at the fastening element at least a preload means is arranged which mechanically interacts with the door handle in the fixing position. By this preload means the door handle is pressed to the outer side of the moveable part when the fastening element takes its fixing position. Therewith, the fastening element does not only fulfil the retaining and fixing of the door handle at the carrier or at the moveable part but at the same time serves for a sufficient tilt stability since the door handle is arranged at the moveable part free of play and therewith free of blur via the carrier. Preferably, the preload means can be configured at the fastening element as a spring tongue which is configured particularly from one material from the fastening element. Therewith, the preload means is configured as an indentation which comprises curves and comfort edges from the fastening element. Ideally, for each connecting means of the door handle a preload means is provided at the fastening element in order to ensure particularly secure retaining of the door handle.

Within the scope of the invention it is possible that a lock cylinder is provided which serves for a mechanical trigger of a function with a safety system of a vehicle. By the safety system of the vehicle it can be an entry system like for example a central locking system. Likewise, it can be an alarm system or a vehicle immobilizer which can be actuated or served by a mechanical lock cylinder. The lock cylinder is thereby arrangeable at the moveable part by the carrier. Hereby, the fastening element can arrange the lock cylinder at the carrier particularly form fittingly. The lock cylinder can at least partially be fit through the preferably ring-like or bracket-like configured first part of the fastening element such that the fastening element serves not only for fastening of the door handle at the carrier but at the same time for fastening of the lock cylinder at the carrier. By this special form of the first part after the feeding through of at least one part of the lock cylinder and a subsequent displacement of the first part and therewith the fastening element the lock cylinder can be arranged in a simple and safe manner at the carrier and therewith at the moveable part of the door handle system.

In order to prevent a penetration of moisture through the opening in the movable part it can be intended that between the door handle and the outer side of the moveable part at least one sealing element is provided. By the existing sealing element the openings in the moveable part are closed during the assembly of the door handle since the door handle pushes to the sealing from the outside which intern is pressed against the outer side of the moveable part in order to seal the area about the openings in the moveable part. Further, these sealings effect that the door handle does not damage a coated surface of the outer side of the moveable part.

In order to achieve an increased tilt stability of the assembled door handle at the moveable part it is provided that the connecting means extending into the carrier are surrounded by complementary configured guidance areas in the carrier. Hereby, it is an advantage when the connecting means provide a certain length since therewith the contact area between the connecting means and the complementary configured guidance areas at the carrier is enlarged.

According to the invention it is provided that the fastening element comprises at least a first and a second part. Thereby, the second part can be provided for the fixation of the door handle at the carrier and the first part for the fixation of the closing cylinder. Therewith, the first and the second part receive a special function of the fastening element respectively.

Further, it is possible within the scope of the invention that at least at the second part of the fastening element counter guidance means are provided which interact with a guidance means at the carrier, particularly formfittingly. Therewith, the fastening element is at least also retained and possibly guided at the second part at the carrier. Additionally, this second part serves for the retaining of the door handle at the carrier.

The fastening element can for example be configured in form of a pusher which, however, can comprise a vertically offset contour which is ideally geometrically complementary to a contour of the carrier in order to be able to interact with the contour in the scope of a guidance, particularly linear guidance. Hereby, it is possible that the material strength of the fastening element varies within particularly critical parts of the fastening element are configured with a greater material strength. Thereby, these critical areas are for example the area about the fastening means of the fastening element. Particularly, the elastically deformable end of the second part of the fastening element can comprise another particularly thinner material strength for the configuration of the elastic deformability than the remaining parts of the first fastening element.

With a further measure improving the invention it can be intended that the adjustment element is particularly arranged directly at the carrier in an acceptance and that the fastening element is longitudinally displaceable between the release position and the fixing position. Hereby, the fastening element almost serves as a drive for the fastening element. The adjustment element itself can be configured as a screw or spring element, particularly with a resting means. The adjusting element configured as a screw is thereby with its screw head pivotably but stationary arranged in the acceptance of the carrier. The thread of the screw however is a thread of the fastening element, particularly in a thread hole at the frontal side of the ring-like or clip-shaped configured first part. A turning of the screw arranged in the carrier acceptance effects that the first part and therewith the whole fastening element along the thread of the screw is longitudinally displaceable. Insofar that the adjustment element is configured as a spring element this spring can stabilize in the acceptance at the carrier and push against the displaceable fastening element in order to transfer this from the release position into the fixing position. Ideally, the adjustment element configured as a spring element comprises a resting means, wherein the spring element is retained in an initial position in which the fastening element is in its released position. Thereby, that the resting means is detached from the spring element in the acceptance at the carrier the spring force of the spring element pushes the fastening element automatically in the fixing position. Since the spring force of the spring element acts permanently to the fastening element this is securely retained in the fixing position. A displacement of the fastening element from the fixing position into the release position can for example occur by a turning back of the adjustment element configured as a screw or by a counter pressure to the fastening element against the spring force of the spring element.

In order to avoid manipulations of the assembled door handle the adjustment element can be reachable and adjustable by a breakthrough in the movable part. Hereby, it is recommended that the adjustment element is not reachable from the outer side of the moveable part. Rather, the movable breakthrough in the moveable part can be arranged at the frontal side which is only reachable when the moveable part is at least partially opened, wherein the frontal side is released. In order to facilitate the assembly of the door handle system at the moveable part it can be provided that the adjusting element is formfittingly connected with a fastening element. Hereby, it can be achieved that the adjusting element is directly connected with the fastening element and a movement of the adjusting element directly acts to the fastening element. For this purpose, the adjusting element can be connected directly via a thread with a fastening element, particularly a thread hole in the ring-like or bracket-like configured first part of the fastening element or the adjustment element is materially bonded with a fastening element or the adjustment element is for example riveted, welded, soldered or glued to the fastening element.

Optionally, it is possible within the scope of the invention that at least a connecting means of the door handle is configured at least from one part from one material or monolithically with a door handle. Thereby, the connecting means are almost established by the door handle itself. The connecting means can also be welded or injected to the door handle or can be screwed to the door handle. Particularly, the connecting means can extend rod-like from the ends of the door handle and are particularly mainly adjusted orthogonally to the longitudinal extension of the door handle. By the orthogonal arrangement of the connecting means to the longitudinal extension of the door handle it can be achieved that the door handle can be assembled by a mainly perpendicular pre-accession to the moveable part.

Further, it can be intended according to the invention that both connecting means of the door handle are adjusted parallel to one another. Hereby, it is possible that the connecting means comprise different lengths. Particularly, with a non-symmetrical outer contour of the door handle an adjusted filling measuring of the connecting means to the moveable part or the therewith arranged carrier to the geometry is recommended.

Further, it is possible according to the invention that at the fastening element fastening means are arranged which are particularly provided at the second part. Hereby, the fastening means mechanically interact with the fixing position of the fastening element with a counter fixing means at the connecting means of the door handle. This mechanic interaction is normally formfittingly such that almost the fastening means of the fastening element lock the connection means with the help of the counter fastening means. Hereby, the counter fastening means at the connecting means can be configured as notches in which the fastening means of the fastening element are retracted by the displacement in the fixing position. In order to facilitate this retraction at least one leading inflow slope as at least a fastening means or the counter fastening means can be provided. As far as the counter fastening means at the connecting means of the door handle are configured as notches the leading inflow slope at the counter fastening means can be existent. At the same time at the fastening means and of the fastening element leading inflow slopes can be existent which are geometrically synchronized to the mechanically interacting leading inflow slopes at the door handle. Further, it should be mentioned that the counter fastening means at the connecting means do not necessarily have to be notches or recesses, but can further be indentations which can formfittingly interact with a fastening means of the fastening element. Ideally, the fastening means of the fastening element encompasses the counter fastening means at the connecting means on the door handle on both sides, wherein a particularly secure form fit for the retaining of the door handle at the moveable part results. Additionally, at the fastening means the already described preload means can be provided, wherein an improved fastening of the door handle is achievable.

The door handle system according to the invention can optionally be configured with at least one electronic unit which is technically or via cable or radio connectable with a security system of vehicle data. Hereby, it is possible that at least a part or the whole electronic is arrangeable in the door handle. In the door handle thereby for example at least one proximity sensor, an antenna to a communication with extern mobile identification device or a switch element can be arranged, wherein the comfort of the door handle system can be improved. Hereby, for example a Passive Keyless Entry or an Active Keyless Entry and a Passive Keyless Go system can be realized. For this purpose, it is provided that in the door handle a cavity is provided which can at least receive a part of the electronic unit. Further, the arrangement of a part of the electronic unit in the door handle has the advantage that between an approximation of a user to the vehicle and an interaction of the user into the recessed grip which is configured from the door handle and the moveable part can be distinguished based on technical measurement reasons. Hereby, the comfort with the access vehicle by the door handle system according to the invention can be significantly improved.

Further, it is possible that the previously described electronic unit comprises a light module which is preferably arrangeable in the door handle in order to realize an apron lighting. Likewise, in the door handle data interface in form of a Bluetooth or NFC (near field communication) interface can be existent. By these interfaces, an external data exchange between the security system or the vehicle electronic with an external device can be enabled in a simple manner without undertaking an access to the vehicle.

In order to be able to connect the door handle via a data connection with a safety system or the vehicle related electronic it can be provided that at at least one connecting means of the door handle an electronic plug connection is arranged which electrically interacts with a counter plug connection at the carrier. Ideally, the electric plug connection at the connecting means of the door handle is configured such that it is automatically connected with a counter plug connection at the carrier when the door handle is introduced through the opening at the moveable part into the carrier. A locking or fastening of the door handle by the displacement of the fastening element at the same time leads to a locking of the plug connection with the counter plug connection. In this manner, the assembly of the door handle system according to the invention can be further facilitated. Likewise, such a configuration of the electric plug connection at the connecting means comprises the advantage that a plug does not necessarily have to be manually connected from the inner side of the moveable part with the counter plug connection. However, it is possible that between the connecting means and the electric plug connection a wire is provided with which the plug connection of the door handle is geometrically flexible arrangeable at the carrier or at the inner side of the moveable part.

Further, it should be mentioned that at least the door handle or the carrier is producible as an injection moulding part, particularly from plastic. The door handle from plastic has the advantage that the electronic unit is partially arrangeable in the door handle without further effort. Thereby, the plastic preferably does not shield electro magnetic fields. In order to achieve a particularly stable configuration of the door handle system the carrier can at least partially be from a metal casting, particularly light metal casting. Further, it is an advantage when the carrier has honeycomb-like reinforcement rips which increase the stability of the carrier and at the same time reduces the weight. Ideally, the guidance means for the fastening means are injected at the carrier at the same time.

The present invention is further directed to a secure system for vehicle with a door handle system according to the invention. Likewise, the invention comprises a vehicle with at least one door handle system according to the invention or the security system according to the invention.

The present invention is further directed to a method for the assembly of the door handle system for the actuation of a moveable part of the vehicle, particularly a door or a hatchback door or suchlike according to the preamble of claim 20. According to the invention it is provided with such an assembly method that the following steps for the assembly of the door handle system at the moveable part of the vehicle are performed:

a) Assembly of a first part and a second part of the fastening element at the carrier and coupling of the first part and second part to one another, wherein while the coupling of the parts to one another at least a second part is loss-proof retained at the carrier
b) Fastening at the carrier at the inner side of the moveable part
c) Linear retraction of the connecting means of the door handle from the outer side through the openings in the moveable part into the carrier
d) formfitting fixation of the door handle through adjustment of the fastening element from the release position into the fixing position.

According to steps a), b), c) and d) it has to be noted that they can be performed in the chronological or temporal order a), b), c), d). Further, a subdivision of the previously said steps can occur. Thus, it is for example possible that in step d) by the adjustment of the fastening element into the fixing position both connecting means are fixed. Hereby, the fastening element can be subsequently displaced. Like previously described the adjustment can be performed automatically when for example the adjustment element comprises a spring which raises the necessary adjustment force.

Both parts of the fastening elements are assembled separately from one another assembled at the carrier. Particularly, both parts are assembled at the carrier such that those after the assembly are only moveable in one degree of freedom, particularly linear relative to the carrier. The coupling of the first part and the second part to one another occurs after the assembly of both parts at the carrier meaning that these are already guidably retained at the carrier.

Further, it is possible that in step b) the carrier is initially plugged to the moveable part and subsequently is secured with a fastening element at the moveable part. The plugging of the carrier at the moveable part can occur by the already described retaining means.

Further, a step c1) can be provided with which closing cylinder is introduced from the inner side of the moveable part into the carrier in order to be assembled to the carrier. Herefor, step d) can serve which at the same time by the adjustment of the fastening elements in the fixing position at the carrier through the fastening element at the same time fixes the closing cylinder. Thereby, the closing cylinder and the door handle are formfittingly retained in the fixing position at the same time in step d) by the fastening element.

It can be provided particularly preferred with a method that for a coupling of the first part, particularly at least a coupling element of the first part at the second part, particularly at at least a counter coupling element of the second part, the second part is elastically deformed at the edge facing the first part. Hereby, it can be ensured that after coupling of both parts to one another parts cannot be released by themselves. With an elastically deformation of the elastic deformable end of the second part the elastic deformable end is preloaded with a certain force. During the coupling the preload serves for a coupling of the at least one counter coupling element at at least one coupling element. Thus, the preload can serve for a secure latching of the at least one counter coupling element to the at least one coupling element. After coupling or latching the preload ensures that the second part cannot be released from the first part, particularly not when the door handle system is completely assembled.

Thus, with an assembly method it can be preferably provided that for the assembly of the second part of the fastening element at the carrier the longitudinal holes/recesses meaning the counter guidance means of the fastening element are aligned flush to the guidance means of the carrier and subsequently the second part can be plugged to the carrier past the guidance means of the carrier, wherein during the plugging of the second part to the carrier the second part elastically deforms at the end facing the first part and that subsequently by a deformation of the second part along the guidance means of the carrier in the direction of the first part. The second part is coupled with a first part, wherein the elastic end of the second part deforms in its initial position or mainly in its initial position previous to the elastic deformation meaning the second part is initially plugged to the carrier, wherein this can only occur when the guidance means of the carrier and the counter guidance means of the second part are aligned to one another that they can be guided past one another. The longitudinal holes/recesses of the second part in the guidance means of the carrier are preferably dimensioned such that the guidance means can be just guided through the longitudinal holes/recesses during plugging the second part to the carrier. In this plugging position the elastic deformable end of the second part is pushed against the first part, particularly against the coupling elements of the first part preferably configured as projections that the elastic deformable end elastically deforms by developing a pretension. Only when the two parts are moved towards another the coupling element of the first part and the counter coupling element of the second part are aligned to one another such that they can receive the desired coupling. By a displacement of the second part in direction of the first part it is ensured by the guidance means of the carrier or the counter guidance means of the second part that the second part is loss-proof retained at the carrier.

Likewise, with the assembly method according to the invention the door handle system according to the invention can be used like previously described with all features.

BRIEF DESCRIPTION OF THE SEVERAL VIEWS OF THE DRAWINGS

Further measures and advantages of the present invention result from the claims, the following description and the drawings. Likewise, the disclosed features from the door handle system according to the invention apply for the assembly method according to the invention and vice versa. In the drawings the invention is shown in different embodiments. Thereby, features described in the claims and in the description can be essential for the invention each single by themselves or in any combination. It is shown:

In the subsequent figures the identic reference signs are used for the same technical features even in different embodiments.

DESCRIPTION OF SPECIFIC EMBODIMENTS OF THE INVENTION

Figure 1:
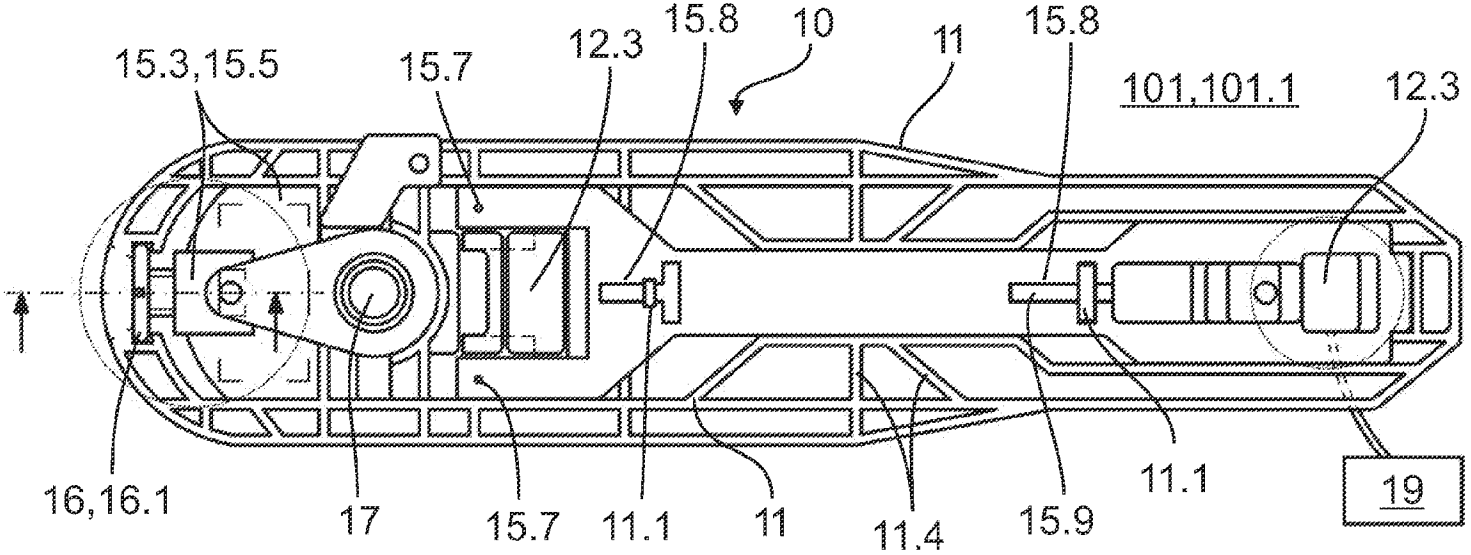
FIG. 1 a schematic rear view of a door handle system according to the invention with its carrier assembled at the inner side of the moveable part, FIG. 2*a* a detail enlargement from FIG. 1 from an adjustment element of the door handle system according to the invention, FIG. 2*b* a comparable detail enlargement from FIG. 2*a* however with a differently configured adjustment element, FIG. 2*c* an exemplarily detail enlargement from a right fastening area of the door handle at the carrier from FIG. 1, FIG. 3 a partial sectional view through the door handle system according to the invention from FIG. 1 in the release position of a fastening element, FIG. 4 an enlargement of the right fastening area of the door handle from FIG. 3, FIG. 5 a comparable sectional view through the door handle system according to the invention from FIG. 3 however in a fixing position of the fastening element, FIG. 6 a detail enlargement from FIG. 5 from the right fastening area comparable to FIG. 4, FIG. 7 a schematic view of a vehicle with a door handle system according to the invention, FIG. 8 in a perspective view schematically the first and second part of the fastening element during the assembly at a carrier of a further door handle system according to the invention, FIG. 9 in a perspective view schematically the first and second part of the fastening elements according to FIG. 8 during the coupling with one another, and FIG. 10 in a perspective view schematic the coupling fastening element according to FIG. 9 in the fixing position.

FIG. 1 shows a rear view of a door handle system 10 according to the invention which is assembled at the inner side 101.1 at the moveable part 101 of the vehicle 100. Therewith, from a mounted door handle 12 only the connecting means 12.3 are visible which serves for the fastening of the door handle 12 at the carrier 11. For this purpose at the carrier 11 a fastening element 15 is provided which is configured in form of a pusher. The fastening element 15 itself formfittingly retained via guidance means 11.1 at the carrier 11, wherein counter guidance means 15.9 in form of longitudinal holes are provided with enlargements at the fastening element 15. The fastening element 15 shown in FIG. 1 comprises a first section 15.3 and a second section 15.4, wherein the first section 15.3 corresponds mainly to a first part 15.5 and the second section 15.4 corresponds mainly to a second part 15.6 of the fastening element 15. The first section 15.3 serves thereby to secure a possibly existing locking cylinder 17 formfittingly at the carrier 11. In this FIG. 1 only the rear part of the locking cylinder 17 is shown which is connected with a lever for the transfer of the mechanic turning movement of the closing cylinder. The second section 15.4 serves for the fixation of the door handle 12, particularly by connecting means 12.3 of the door handle. The exact functionality is described in detail in FIGS. 3, 4, 5 and 6. Like it is shown in FIG. 1 the fastening element 15 is presently configured in two parts 15.5, 15.6, wherein the two parts are formfittingly connected with one another by the shown connecting means 15.7. These connecting means 15.7 can be configured from bolts which extend from the first part 15.5 of the fastening element 15 and which formfittingly interact with holes in the second part 15.6 of the fastening element 15. The adjustment elements 16 can be configured as rivets or screws. Further, it is possible that the two parts 15.5, 15.6 are materially bonded with one another. Like previously described it is also possible that the whole fastening element 15 is configured from one part.

In FIG. 1 at the left edge of the carrier 11 an acceptance 11.3 for an adjustment element 16 is shown which is shown in form of a screw 16.1. Likewise, the honeycomb-like structure of the carrier 11 with its reinforcement rips 11.4 is shown.

Figure 2C:
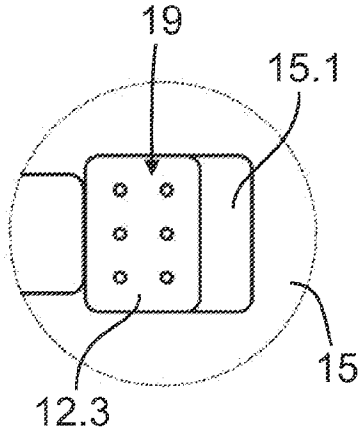
Figure 2B:
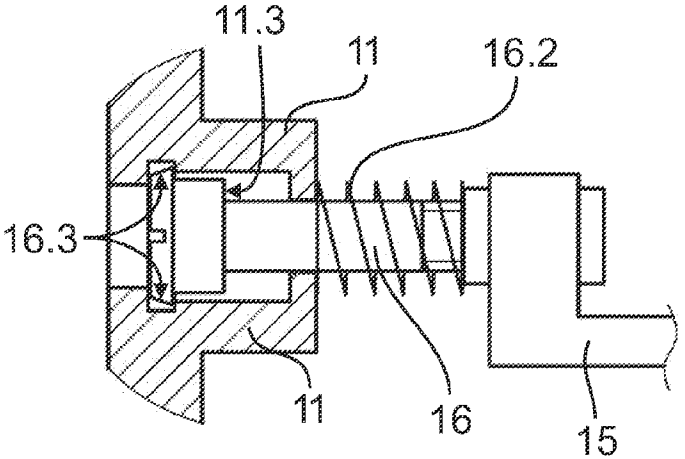
Figure 2A:
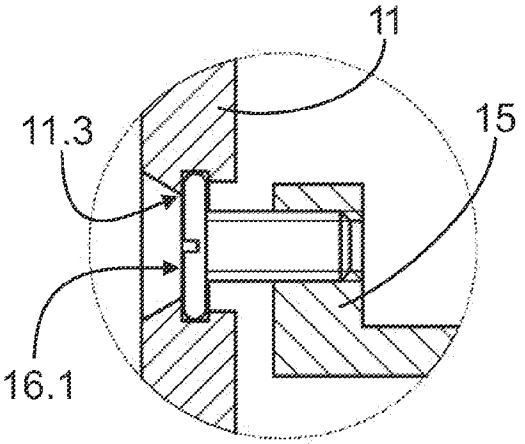

In FIG. 2*a* a detail enlargement of the left area of the carrier 11 with the adjustment element 16 is shown. Hereby, it is shown that the adjustment element 16 is configured as adjustment screw 16.1. The screw head is thereby formfittingly, but turnably arranged in the acceptance 11.3 of the carrier 11. Hereby, it is effected that the adjustment element 16 remains stationary at the carrier 11. The thread of the screw 16.1 interacts with the screw of the fastening means 15, particularly in the first section 15.3. Thereby, a turning of the screw through the existing through hole in the carrier 11 leads to a longitudinal displacement of the whole fastening element 15 in the direction of the shown arrow 25. Therewith, the fastening element 15 can be moved from a release position I in a fixing position II and back by a turning of the adjustment screw 16.1. Therewith, it is obvious that the whole door handle 12 can be moved between a release position I and a fixing position II only by an actuation of the adjusting element 16.

In the second FIG. 2*b* an optional configuration of the adjustment element 16 is shown comparable to the detail enlargement of FIG. 2*a*. Hereby, the adjustment element 16 is shown as a spring 16.2 which appropriately comprises a resting means 16.3. Like it is shown the adjustment element 16 is mounted in an acceptance 11.3 of the carrier 11. Thereby, initially the adjustment element 16 is mounted in the existing resting means 16.3 in recesses in the acceptance 11.3. In case the screw like adjustment element 16 is turned by a vehicle key projection in the head area the resting means 16.3 are getting out of the recesses and the spring 16.2 pushes the whole adjustment element 16 into direction of the shown arrow, wherein the fastening element 15 is transferred from its release position I in the fixing position II. For this purpose, the adjustment element 16 is rigidly connected with the fastening element 15. The assembly of such a configured door handle system according to the invention is particularly simple since the locking of the door handle 12 is achievable only by a slight turning of the adjusting element 16.

In the further FIG. 2*c* an enlargement of the right connecting means 12.3 of the door handle 12 of FIG. 1 is shown in exemplary form. Hereby, the head area of the connecting means 12.3 comprises contacts of the plug connection 19 which are electrically connectable with a counter plug connection at the carrier 11. Therewith, the fastening of the door handle 12 in the carrier 11 leads at the same time to an electrical connection of the part of the electronic unit 13 arranged in the door handle with the carrier 11 or the vehicle related electronic. Optionally, from at least one connecting means 12.3 a wire can be lead out with a plug connection 19 like shown in FIG. 1.

Figure 3:
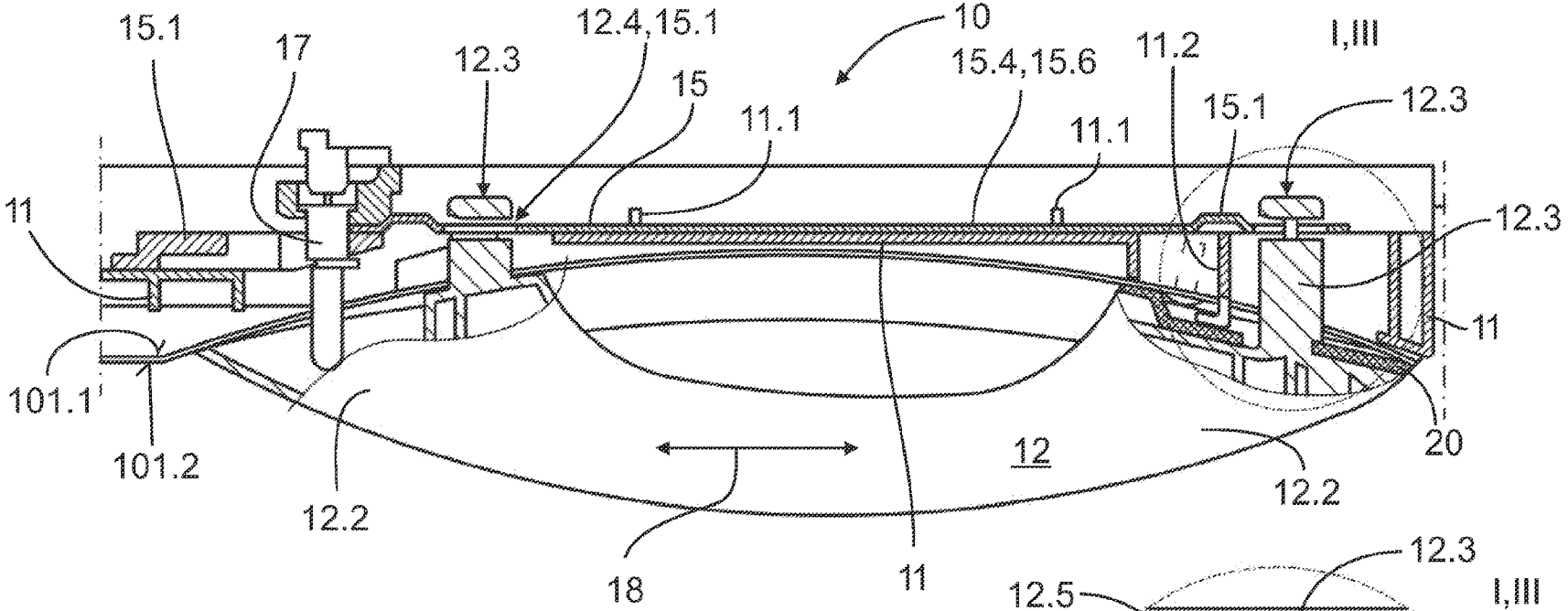

In FIG. 3 a door handle system 10 according to the invention with a partial cross section over the longitudinal extension 18 is shown. The fastening element 15 is thereby in a release position I, wherein the carrier 11 has already taken an assembly position III at the moveable part 101. Like it is shown the fastening element 15 is configured from two parts 15.5, 15.6. The first part 15.5 can thereby be configured as a casting in order to effect a particularly secure fastening of the lock cylinder 17 at the carrier 11. This lock cylinder 17 is formfittingly secured by a displacement of the fastening element 15 from the release position I into the fixing position II. Therefore, the fastening element 16 with its first section 15.3 is driven behind the projection of the lock cylinder 17, wherein a form fit is configured. The second part 15.6 of the fastening element 15 is configured metal sheet-like and comprises two through holes for the connecting means 12.3 of the door handle 12. In the mounting position III of the carrier 11 and the release position I of the fastening element 15 the door handle 12 is guided through the opening 101.3 in the moveable part 100, wherein at the same time the connecting means 12.3 are partially guided through the carrier 11. Like it is shown in FIG. 3 the door handle 12 comprises a longitudinal extension 18 wherein the door handle comprises two edges 12.2. At the two edges 12.2 the rod-like connecting means 12.3 extend which are mainly orthogonally adjusted to the longitudinal extension 18 of the door handle 12. Via this rod-like connecting means 12.2 the previously described sealings can be pushed.

Figure 4:
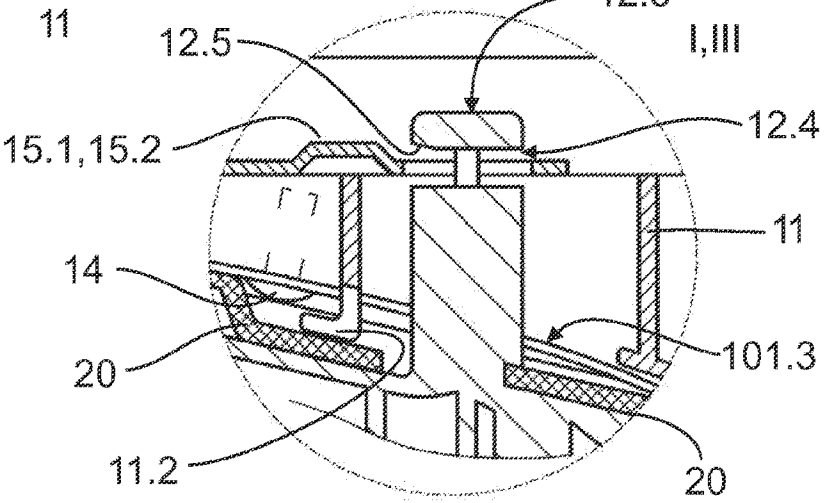

In FIG. 4 it is shown how the carrier 11 is retained with a hook-like retaining means 11.2 in the mounting position III at the moveable part 101. Additionally, a fixation element 14 is provided in form of a screw in order to adjust and retain the carrier 11 exactly at the moveable part 101. The fixation element 14 is configured in form of a screw and is guided through the moveable part 101 at the outer side 101.2 and acts with a thread at the carrier 11 which is indicated in FIG. 4. Further, between the door handle 12 and the moveable part 101 a sealing 20 is provided around the opening 101.3.

Figure 5:
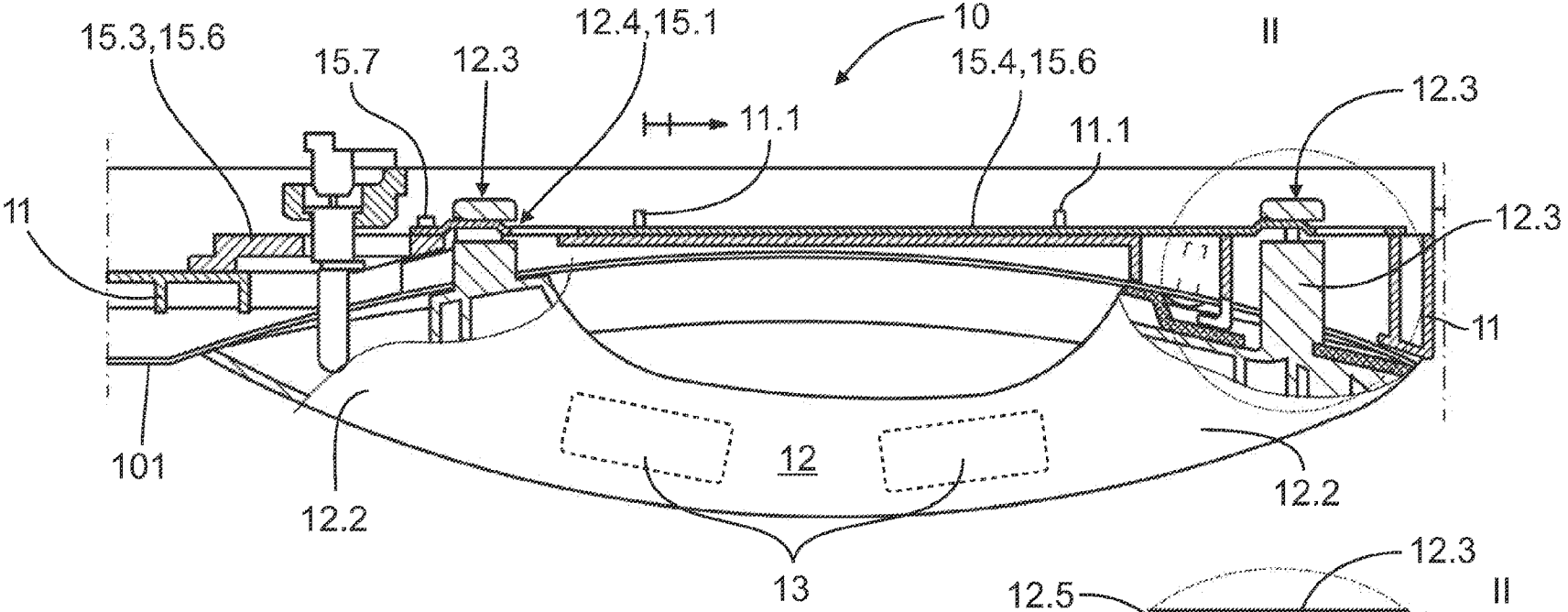
Figure 6:
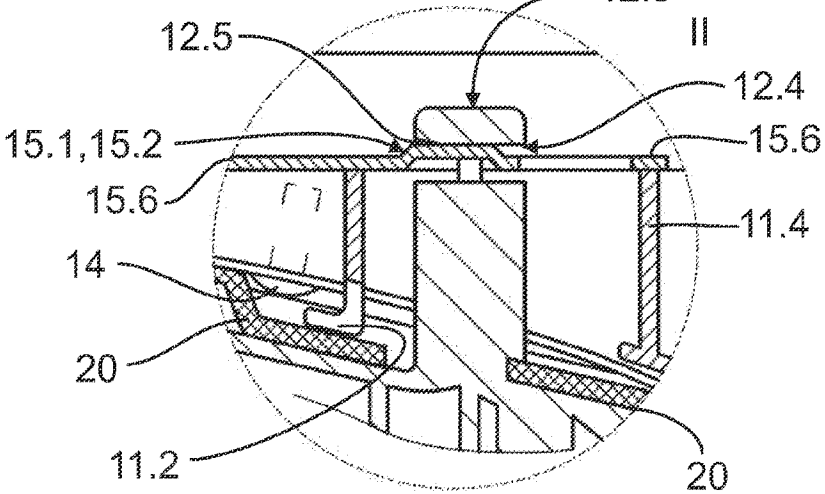

From the further FIGS. 5 and 6 the locking of the door handle 12 at the carrier 11 is shown. For this purpose, the fastening element 15 is transferred from its release position I in its fixing position II through the actuation of the adjusting element 16. This transfer occurs in the present case through a pure linear movement of the fastening element 15. Hereby, the whole fastening element 15 is displaced along the guidance means 11.1 at the carrier 11. Hereby, corresponding longitudinal holes 15.9 are provided in the fastening element 15.

In FIG. 6 the generated form fit between the fastening element 15 and the door handle 12 is shown. For this purpose at the fastening element 15 the fastening means 15.1 configured as projections are provided which are brought into recesses or notches in the connecting means 12.3. These recesses or notches configure counter fastening means 12.4 for the fastening means 15.1. In order to facilitate the retraction of the fastening means 15.1 into the counter fastening means 12.4 leading inflow slopes 12.5 are provided at the counter fastening means 12.4 and the fastening means 15.1. Additionally, the fastening means 15.1 comprise preload means 15.2 as spring tongues, wherein an increased contact pressure of the door handle 12 at the outer side 101.2 of the moveable part 100 is affected. These preload means 15.2 are configured as trapezoid-like configurations of the fastening means 15.1, wherein the inclinations at the same time configure leading inflow slopes for the counter fastening means 12.4 of the door handle 12. The fastening means 15.1 extend into the counter fastening means 12.4 on both sides of the connecting means 12.3. Therewith, the punctual closing of the door handle 12 can be prevented, wherein likewise the stability of the fastening can be significantly increased.

Figure 8:
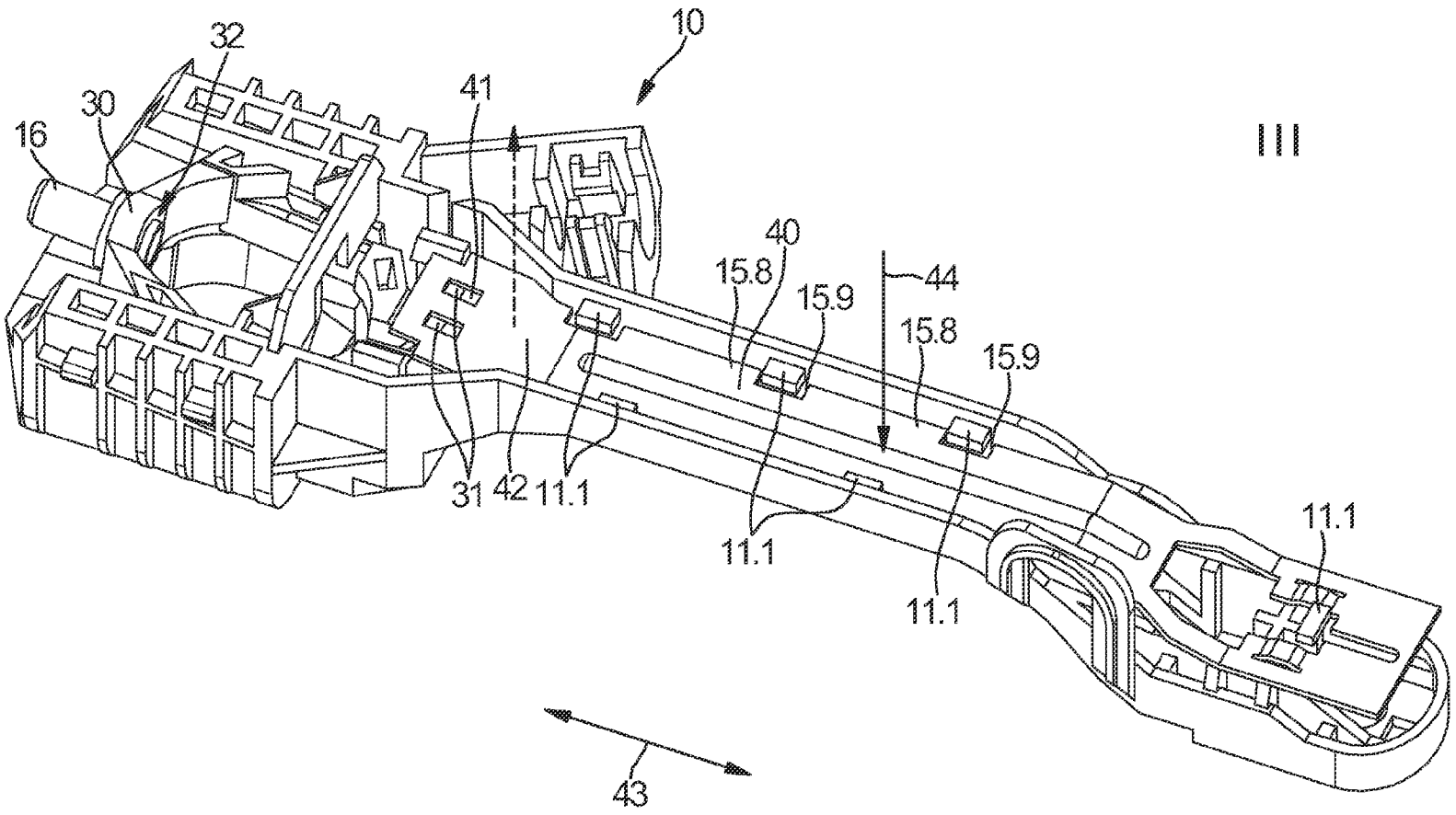

FIG. 8 schematically shows in a perspective view the first part 30 and the second part 40 of the fastening element 15 during the assembly at a carrier 11 of a further door handle system 10 according to the invention. The second part 40 is preferably configured as a locking system and comprises an elastic deformable area at the end 42 facing the first part 30. In the elastic deformable end 42 the second part comprises counter coupling elements 41 here in form of rectangular recesses. The carrier 11 comprises guidance means 11.1 which serve for a guidance of the mounted second part 40. The guidance means 11.1 are configured at two opposing sides of the carrier as wing like projections. The second part 40 comprises recesses/longitudinal holes 15.9 at its sides which serve for plugging on the second part 40 via the guidance means 11.1 of the carrier 11. This plugging on is shown in FIG. 8. The plug direction of the second part 40 to the carrier 11 is indicated with reference sign 44. The second part 40, the carrier 11 and the recesses/longitudinal holes 15.9 in the second part 40 and the guidance means 11.1 of the carrier 11 are configured and dimensioned such that during the plugging on of the second part 40 to the carrier 11 the elastic deformable end 42 of the second part 40 is deformed.

Figure 9:
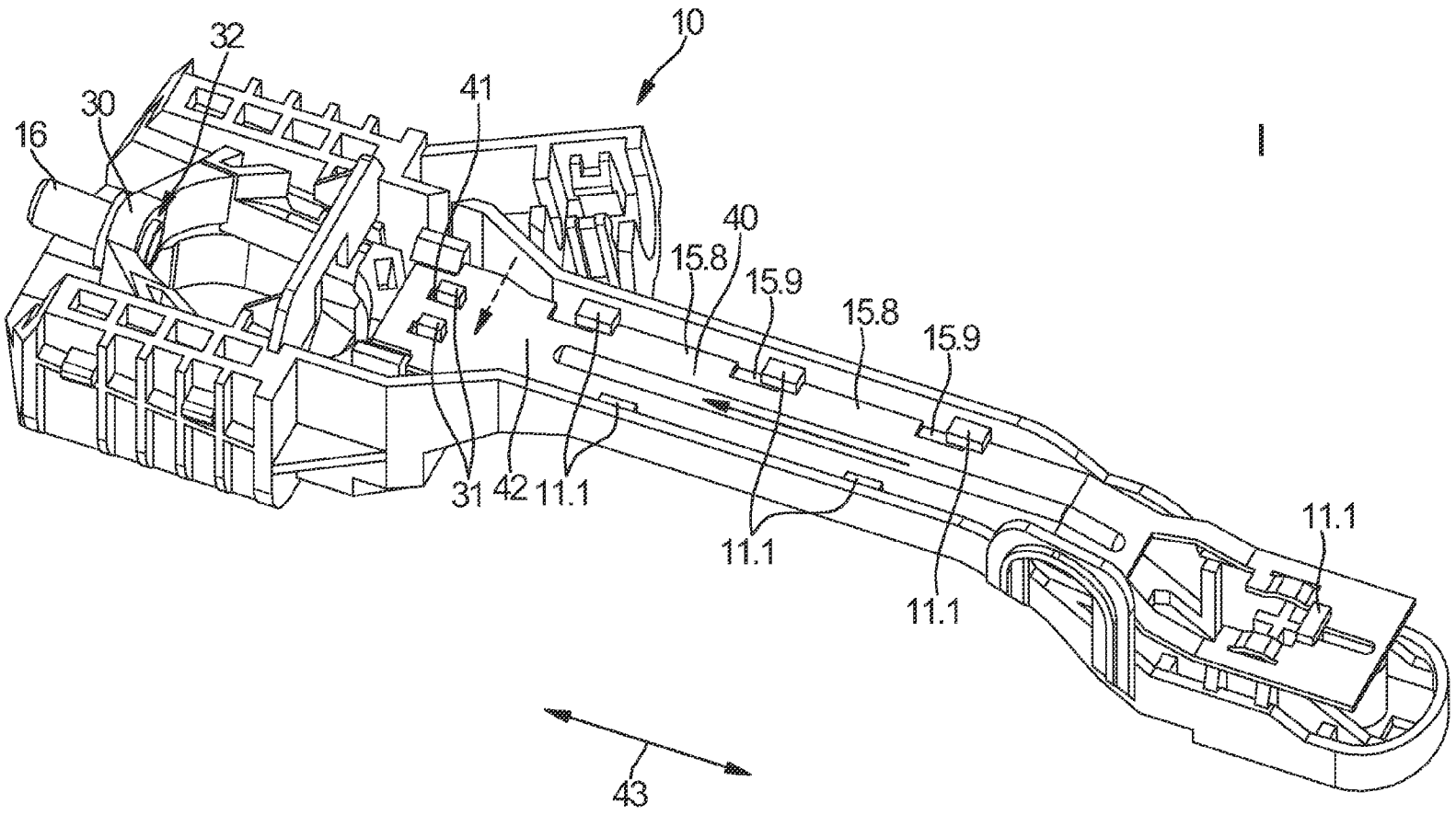

FIG. 9 schematically shows a perspective view of the first part 30 and the second part 40 of the fastening element 15 according to FIG. 8 during the coupling with one another. Meaning after the assembly of the second part 40 to the carrier 11 and the therewith connected deformation of the elastic deformable end 42 of the second part 40, the second part 40 is displaced from the mounting position III into release position II linear along the guidance means 11.1 of the carrier 11 until the counter coupling means 41, here in form of angular recesses, to which coupling elements 31 of the first part 30 rest due to its pretension caused by their deformation. After the resting of the counter coupling elements 41 to the coupling elements 31 configured as projections the second part 40 is coupled formfittingly and lossproof to the first part 30.

Figure 10:
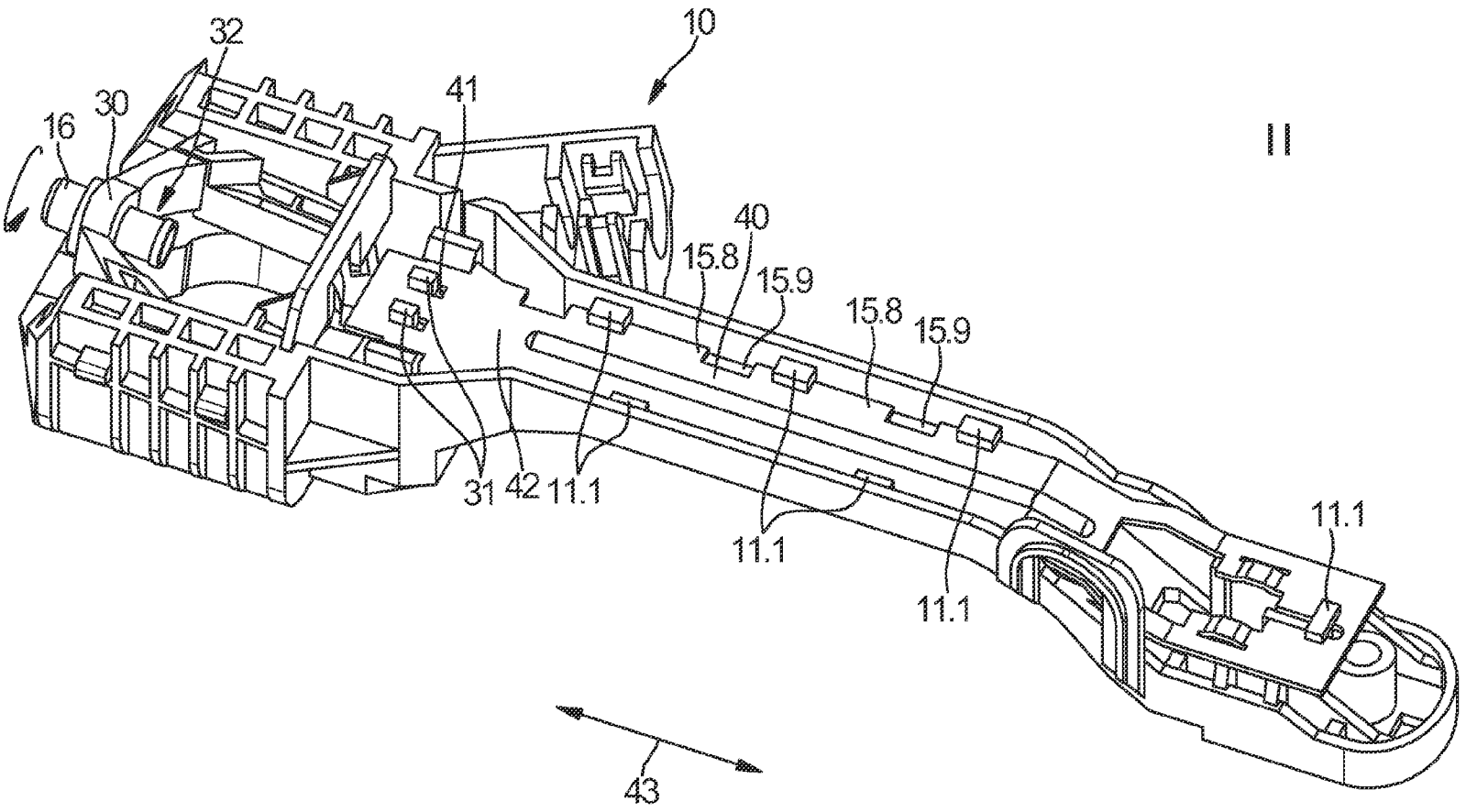

FIG. 10 schematically shows in a perspective view the coupled fastening element 10 according to FIG. 9 in the fixing position II. The ring-like configured first part 30 of the fastening element 15 comprises a thread hole 32 for the acceptance of an adjusting element 16 arranged at the carrier 11. The adjusting element 16 serves for pulling out or guiding away the first part 30 by a turning. In FIG. 10 the first part 30 is transferred from the release position I into the fixing position II by a turning of the adjusting element 16 configured as a screw. In this fixing position II the first part 30 can retain a lock cylinder at the carrier 11 at therewith at the moveable part 101 of the door handle system 10 at least partially guided through the carrier 11 and the inner of the first part 30.

Figure 7:
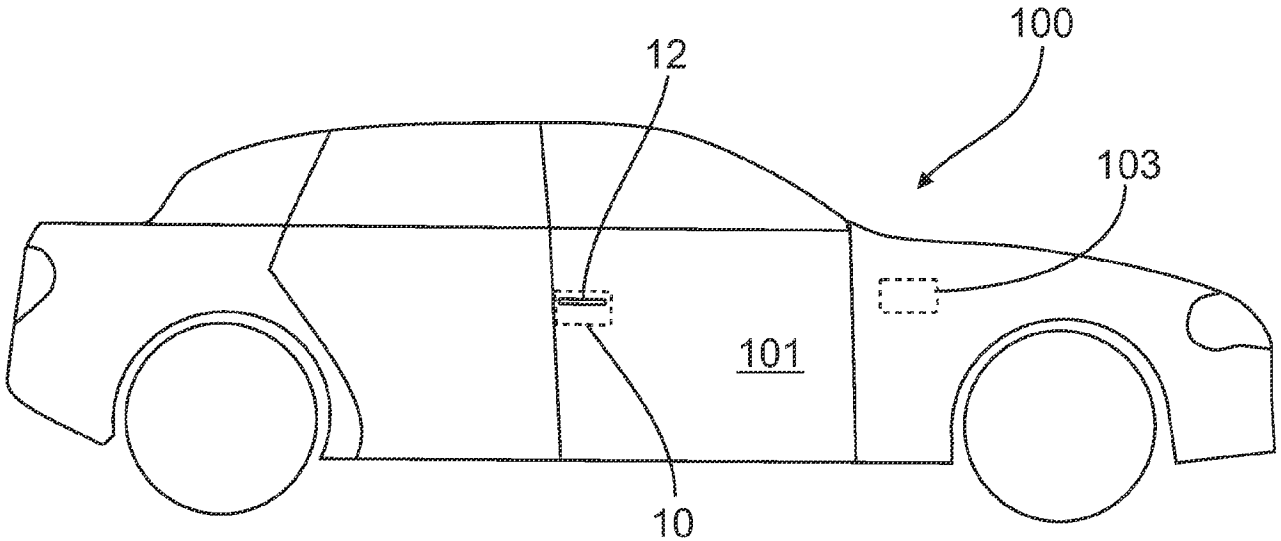

In FIG. 7 the vehicle 100 according to the invention is shown with a safety system 103. Thereby, the door handle system according to the invention at the moveable part 101 is shown which shows a vehicle door.

REFERENCE LIST

10 Door handle system
11 Carrier
11.1 Guidance means for 15
11.2 Retaining means for 101
11.3 Acceptance for 16
11.4 Reinforcement rips
12 Door handle, particularly fixed
12.1 Handle
12.2 End
12.3 Connection means
12.4 Counter connection means for 15
12.5 Chamfer slope
13 Electronic unit of 10/12
13.1 Part of electronic unit in 12
14 Fixation element for 11, particularly screw
15 Fastening element
15.1 Fastening means for 12
15.2 Preload means
15.5 First part
15.6 Second part
15.7 Connection means
15.8 Counter connection means
15.9 Longitudinal holes/recesses for 11.1
16 Adjusting element
16.1 Screw
16.2 Spring
16.3 Resting means
17 Locking cylinder
18 Longitudinal extension for 12
19 Plug connection
20 Sealing for 12
30 First part/clip
31 Coupling element
32 Thread hole
40 Second part/loading metal
41 Counter coupling element
42 Elastic deformable end
43 Shifting direction of 40 or 15
44 Plug direction of 40 to 11
100 Vehicle, particularly motor vehicle
101 Moveable part
101.1 Inner side
101.2 Outer side
101.3 Opening
102 Lock, particularly electro mechanical
103 Safety system
I Release position of 15
II Fixing position of 15
III Mounting position of 11

What is claimed is:

1. A door handle system for actuation of a moveable part of a vehicle with a carrier which is arrangeable at an inner side of the moveable part, the door handle system comprising:

a door handle arrangeable at an outer side of the moveable part by the carrier and mechanically interacting with the carrier at two ends over a longitudinal extension thereof;

a fastening element having first and second parts coupled to move as one unit between at least one release position and a fixing position and vice versa when coupled;

wherein the second part of the fastening element: (1) has longitudinal holes and (2) is mounted between wing projections formed on two opposing sides of the carrier;

wherein the first part of the fastening element has projections sized and shaped to fit in the longitudinal holes; and an adjustment element having an adjustment screw mechanically connected with the fastening element such that a rotation of the adjustment screw linearly displaces the projections within the longitudinal holes for adjusting the fastening element between the at least one release position and the fixing position.

2. The door handle system according to claim 1, wherein the projections are formfittingly arranged at the longitudinal holes.

3. The door handle system according to claim 1, wherein the door handle is rigidly and fixedlyarrangeable at the moveable part.

4. The door handle system according to claim 1, wherein the fastening element is displaceably arranged at the carrier.

5. The door handle system according to claim 1, wherein the carrier is fixable by at least one fixation element at the moveable part.

6. The door handle system according to claim 1, wherein the fastening element mechanically interacts with the door handle in the fixing position, wherein the door handle is pressable at the outer side of the moveable part.

7. The door handle system according to claim 1, wherein a closing cylinder is provided which serves for a mechanical release of a function with a safety system of the vehicle, wherein the closing cylinder is arranged at the moveable part by the carrier and the first part of the fastening element arranges the closing cylinder at the carrier.

8. The door handle system according to claim 1, wherein at least the second part of the fastening element interacts with a guidance element at the carrier.

9. The door handle system according to claim 1, wherein the adjustment element is arranged in an acceptance and the fastening element is longitudinally displaceable between the at least one release position and the fixing position.

10. The door handle system according to claim 1, wherein the adjustment element is achievable and adjustable by a through hole in the moveable part.

11. The door handle system according to claim 1, wherein the first part comprises a thread hole for the acceptance of the adjustment screw.

12. The door handle system according to claim 1, wherein at least part of the fastening element is monolithic with the door handle.

13. The door handle system according to claim 12, wherein the longitudinal holes are aligned parallel to one another.

14. The door handle system according to claim 1, wherein at least one electronic unit is provided which is data-technically connectable with a safety system of the vehicle.

15. The door handle system according to claim 1, wherein at the door handle an electric plug connection is arranged which electrically interacts with a counter plug connection at the carrier.

16. A method for the assembly of a door handle system for the actuation of a moveable part of a vehicle with a carrier which is arrangeable in an inner side of the moveable part a door handle arrangeable at an outer side of the moveable part by the carrier and mechanically interacting with the carrier at two ends via a longitudinal extension thereof, a fastening element having first and second parts coupled to move as one unit between at least one release position and a fixing position and vice versa when coupled, wherein the second part of the fastening element: (1) has longitudinal holes and (2) is mounted between wing projections formed on two opposing sides of the carrier;

wherein the first part of the fastening element having with projections sized and shaped to fit in the longitudinal holes; and wherein the following steps for the assembly of the door handle system at the moveable part of the vehicle are configured:

a) mounting of the first part and the second part of the fastening element at the carrier and coupling of the first part and the second part to one another, wherein during the coupling of the first and second parts to one another at least the second part is loss-proof retained at the carrier, b) fixing of the carrier at the inner side of the moveable part, c) linear introduction of the fastening element from the outer side through openings in the moveable part into the carrier, and d) formfitting fixation of the door handle by adjustment of the fastening element from the at least one release position into the fixing position.

17. The method for the assembly of a door handle system according to claim 16, wherein in step d) through adjustment of the fastening element into the fixing position both the first part and the second part are fixed.

18. The method for the assembly of a door handle system according to claim 16, wherein in step b) the carrier is initially plugged to the moveable part and subsequently fixed with the fastening element at the moveable part.

19. The method for the assembly of a door handle system according to claim 16, wherein in step c1) a closing cylinder is introduced into the carrier from the inner side of the moveable part and through step d) at the same time the adjustment of the fastening element in the fixing position at the carrier is fixed by the first part of the fastening element.

20. The door handle system according to claim 3, wherein the door handle is rigidly and fixedlyarrangeable at the moveable part via the fastening element.

21. The method for the assembly of a door handle system according to claim 17, wherein the fastening element is only linearly displaced.

* * * * *